US008911273B2

(12) United States Patent
Chouinard et al.

(10) Patent No.: US 8,911,273 B2
(45) Date of Patent: Dec. 16, 2014

(54) WATERSPORTS INFLATION VEST

(75) Inventors: Fletcher Chouinard, Ventura, CA (US); Casey Shaw, Santa Fe, NM (US)

(73) Assignee: Patagonia, Inc., Ventura, CA (US)

( * ) Notice: Subject to any disclaimer, the term of this patent is extended or adjusted under 35 U.S.C. 154(b) by 98 days.

(21) Appl. No.: 13/598,441

(22) Filed: Aug. 29, 2012

(65) Prior Publication Data

US 2014/0065904 A1 Mar. 6, 2014

(51) Int. Cl.
*B63C 9/18* (2006.01)
*B63C 9/125* (2006.01)

(52) U.S. Cl.
CPC ..... *B63C 9/18* (2013.01); *B63C 9/1255* (2013.01)
USPC ..... 441/96; 441/106

(58) Field of Classification Search
USPC ..... 441/89, 90, 92, 96, 106, 108; 405/185, 405/186
See application file for complete search history.

(56) References Cited

U.S. PATENT DOCUMENTS

| | | | | |
|---|---|---|---|---|
| 1,428,151 | A | 9/1922 | Drew | |
| 1,504,249 | A | 8/1924 | Klein | |
| 1,723,402 | A | 8/1929 | Browdy | |
| 1,800,960 | A | 4/1931 | Savard | |
| 1,803,898 | A | 5/1931 | Diamond | |
| 1,868,210 | A | 7/1932 | Lehmann | |
| 2,425,206 | A | 8/1947 | Ripley | |
| 2,571,532 | A | 7/1950 | Briscoe | |
| 2,607,934 | A | 8/1952 | Bailhe | |
| 3,004,269 | A | 10/1961 | Dillier | |
| 3,019,459 | A | 2/1962 | Ripley | |
| 3,134,993 | A | 6/1964 | McCoy | |
| 3,199,128 | A | 8/1965 | Nojd | |
| 3,266,069 | A | 8/1966 | O'Link | |
| 3,441,963 | A | 5/1969 | Steinthal | |
| 4,000,534 | A * | 1/1977 | Cerniway et al. | 405/186 |
| 4,097,947 | A | 7/1978 | Kiefer | |
| 4,720,281 | A * | 1/1988 | Matsuoka | 405/186 |
| 4,767,371 | A | 8/1988 | Jackson | |
| 5,184,968 | A | 2/1993 | Michalochick et al. | |

(Continued)

FOREIGN PATENT DOCUMENTS

| | | |
|---|---|---|
| AU | 2007234471 | 5/2008 |
| CA | 1085235 | 9/1980 |

(Continued)

OTHER PUBLICATIONS

Inflatable Wetsuit Could Save Surfers' Lives; Web site; Discovery News; Jun. 13, 2012; United States.

(Continued)

*Primary Examiner* — Lars A Olson
(74) *Attorney, Agent, or Firm* — Lowe Graham Jones PLLC

(57) ABSTRACT

A selectively inflatable watersports inflation device is disclosed. The device is a vest or another wearable device having an inner layer, an outer layer, and a bladder between the inner and outer layers. The device also includes one or more canisters coupled to the bladder and configured to selectively deliver pressurized gas into the bladder to provide flotation when actuated. The device also includes a pressure release valve that can also be manually actuated to release pressure from the bladder. The device can include multiple discrete canisters that can each be deployed independently of one another to provide an inflatable device that can be triggered multiple times even in hazardous conditions such as high surf.

27 Claims, 14 Drawing Sheets

(56) References Cited

U.S. PATENT DOCUMENTS

| | | | | |
|---|---|---|---|---|
| 5,295,765 | A | 3/1994 | Choi | |
| 5,603,648 | A | 2/1997 | Kea | |
| 5,755,172 | A | 5/1998 | Fryberg | |
| 5,759,076 | A | 6/1998 | Bateman et al. | |
| 5,839,933 | A | 11/1998 | Davis, Sr. et al. | |
| 5,911,612 | A | 6/1999 | Steger | |
| 6,217,257 | B1 * | 4/2001 | Garofalo et al. | 405/186 |
| 6,231,411 | B1 | 5/2001 | Vinay | |
| 6,413,132 | B1 * | 7/2002 | Swanson | 441/96 |
| 6,431,934 | B2 * | 8/2002 | Cressi | 441/96 |
| 6,478,510 | B1 | 11/2002 | Young | |
| 6,712,658 | B1 | 3/2004 | Crossley et al. | |
| 6,722,819 | B2 * | 4/2004 | Godoy | 405/186 |
| 7,125,302 | B2 | 10/2006 | Haselsteiner | |
| 7,150,668 | B2 | 12/2006 | Kemp | |
| 7,182,662 | B2 | 2/2007 | O'Meara et al. | |
| 7,305,715 | B2 | 12/2007 | Orsos | |
| 7,347,757 | B1 | 3/2008 | Lanthier | |
| 7,351,126 | B2 | 4/2008 | Turner | |
| 7,540,690 | B2 | 6/2009 | Garcia et al. | |
| 7,937,770 | B1 | 5/2011 | Hernandez | |
| 8,231,421 | B1 | 7/2012 | Hubbard et al. | |
| 2009/0233506 | A1 | 9/2009 | Lee | |

FOREIGN PATENT DOCUMENTS

| | | |
|---|---|---|
| EP | 0023430 | 2/1981 |
| GB | 316454 | 8/1929 |
| GB | 2183554 | 6/1987 |
| GB | 2261590 | 5/1993 |
| GB | 2277906 | 11/1994 |
| WO | WO9710144 | 3/1997 |
| WO | WO9836800 | 8/1998 |
| WO | WO03075692 | 9/2003 |
| WO | WO2004039188 | 5/2004 |
| WO | WO2004056223 | 7/2004 |

OTHER PUBLICATIONS

Welcome to PaddleAir; Website; PaddleAir; United States.

* cited by examiner

WATERSPORTS INFLATION VEST

TECHNICAL FIELD OF THE INVENTION

The invention relates generally to a selectively inflatable and deflatable vest for use in watersports.

BACKGROUND OF THE INVENTION

Watersports are inherently dangerous due to the ever present possibility of drowning. Some sports, such as big wave surfing, compound this danger with immense waves and reefs. When a surfer falls from a surfboard in a 40-foot wave, they can sometimes spend minutes beneath the water before reaching the surface again. Frequently the surfer will not be able to surface before the next wave hits. The motion of the waves can pin the surfer down to the ocean floor and make it extremely difficult to swim to the surface. Other watersports, such as white-water rafting, can create a similarly difficult and potential dangerous situation.

Conventional life preservers have been used for years to keep wearers afloat. However, wearing a life preserver is impractical for many sport applications. In particular, life preservers impede the surfer's paddling motion because they are conventionally positioned on the surfer's chest and stomach area between the surfer and the board. In order to catch a big wave without the aid of a powered watercraft, the surfer must be able to paddle unimpeded.

There have been some attempts at a selectively inflatable vest that includes a pressurized air canister that can be deployed by a ripcord. However, these models cannot be easily deflated and inflated without returning to land and replacing the cartridge. Therefore, there exists a need in the art for a selectively inflatable and deflatable garment, such as a vest, for deployment in deep water such as surf or other potentially dangerous conditions.

SUMMARY OF THE INVENTION

The present disclosure is generally directed to an inflatable, wearable device. The device includes an inflatable bladder and a pressurized gas chamber coupled to the inflatable bladder. The device also has an inflate trigger operably coupled to the pressurized gas chamber. Operating the inflate trigger causes the pressurized gas chamber to deliver at least a portion of the gas within the pressurized gas chamber into the inflatable bladder. The device also includes a deflate trigger operably coupled to the inflatable bladder, and operating the deflate trigger permits at least a portion of the gas to escape the inflatable bladder. The device further has a wearable portion, such as a vest, coupled to the inflatable bladder and configured to secure the inflatable device to a wearer's body.

In other embodiments, the present disclosure is directed to an inflatable device having a vest, a gas pressure source, and a bladder. The gas pressure source is coupled to the bladder to selectively deliver gas to the bladder to pressurize and inflate the bladder. The vest is coupled to the bladder to hold the bladder in place relative to a wearer's chest. The bladder has an inverted V shape having an apex and arms extending from the apex, with the apex of the inverted V being positioned at an intermediate point on the wearer's sternum and extending to the lower portion of the wearer's sternum. The arms of the inverted V shape extend downwardly and outwardly from the apex of the inverted V shape to substantially follow the contour of the wearer's ribcage. The user's stomach area below the sternum is not substantially covered by an inflatable portion. Thus, the bladder is biased toward face-up floatation, while not impeding board paddling.

The present disclosure is also directed to a method of inflating and deflating an inflatable device in a wearable garment. In response to actuating a first inflate trigger, the method includes delivering a discrete amount of pressurized gas into a bladder secured to the wearable garment. The garment holds the bladder in position relative to a wearer's body. After actuating a second inflate trigger, the method includes delivering a discrete amount of pressurized gas into the bladder. After actuating a release trigger a discrete amount of the pressurized gas is released from the bladder. The first inflate trigger can be actuated before or after the second inflate trigger is actuated. The release valve can be actuated after the first inflate trigger is actuated, after the second actuation trigger is actuated, or after both the first and second inflate triggers are actuated.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

To facilitate the understanding of this invention, a number of terms are defined below. Terms defined herein have meanings as commonly understood by a person of ordinary skill in the areas relevant to the present invention. Terms such as "a," "an," and "the" are not intended to refer to only a singular entity, but include the general class of which a specific example may be used for illustration. The terminology herein is used to describe specific embodiments of the invention, but their usage does not delimit the invention, except as outlined in the claims.

Figure 1A:
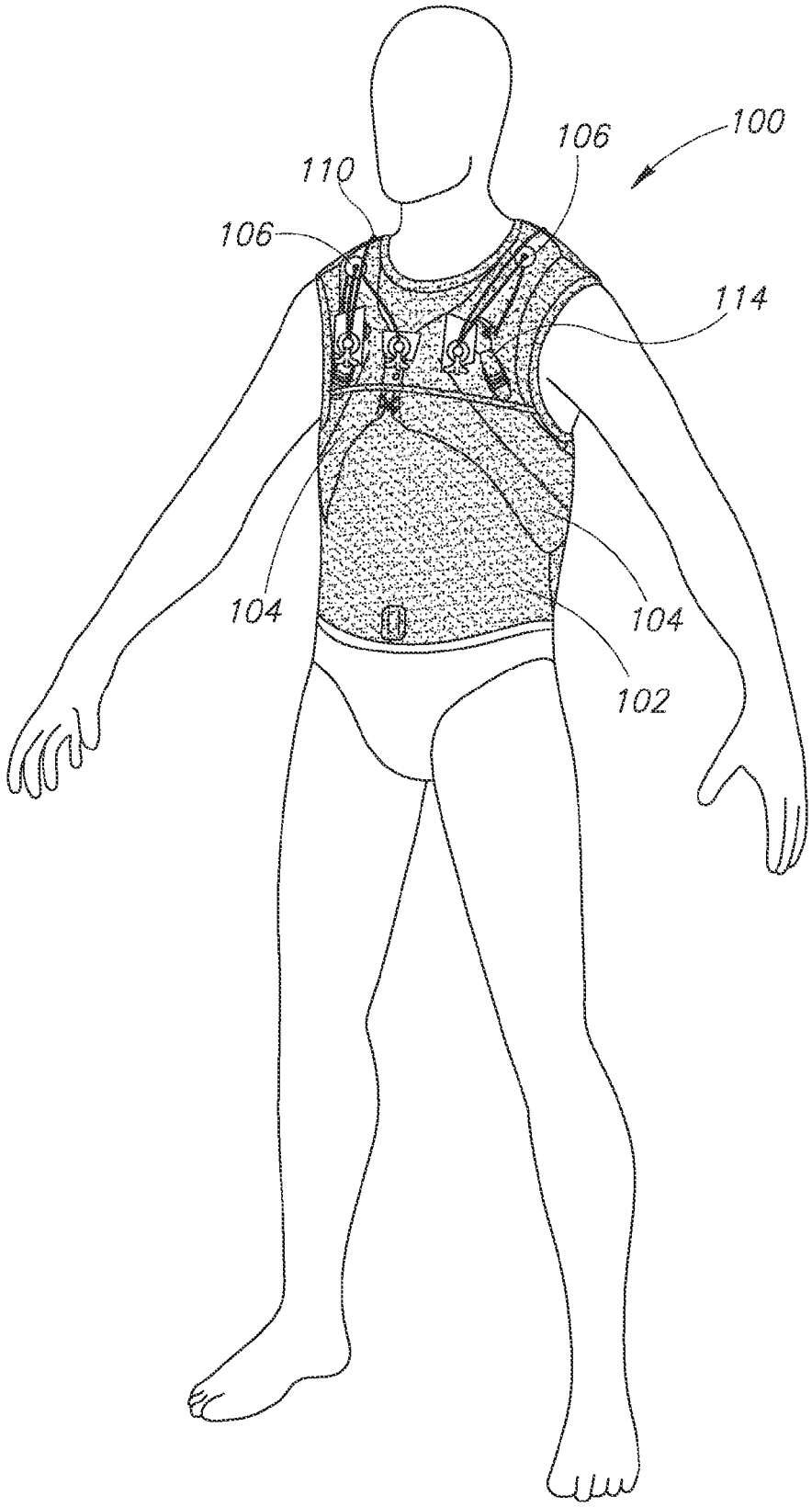
FIGS. 1A and 1B are front and rear views, respectively, of an inflatable, wearable device according to embodiments of the present disclosure.
Figure 1B:
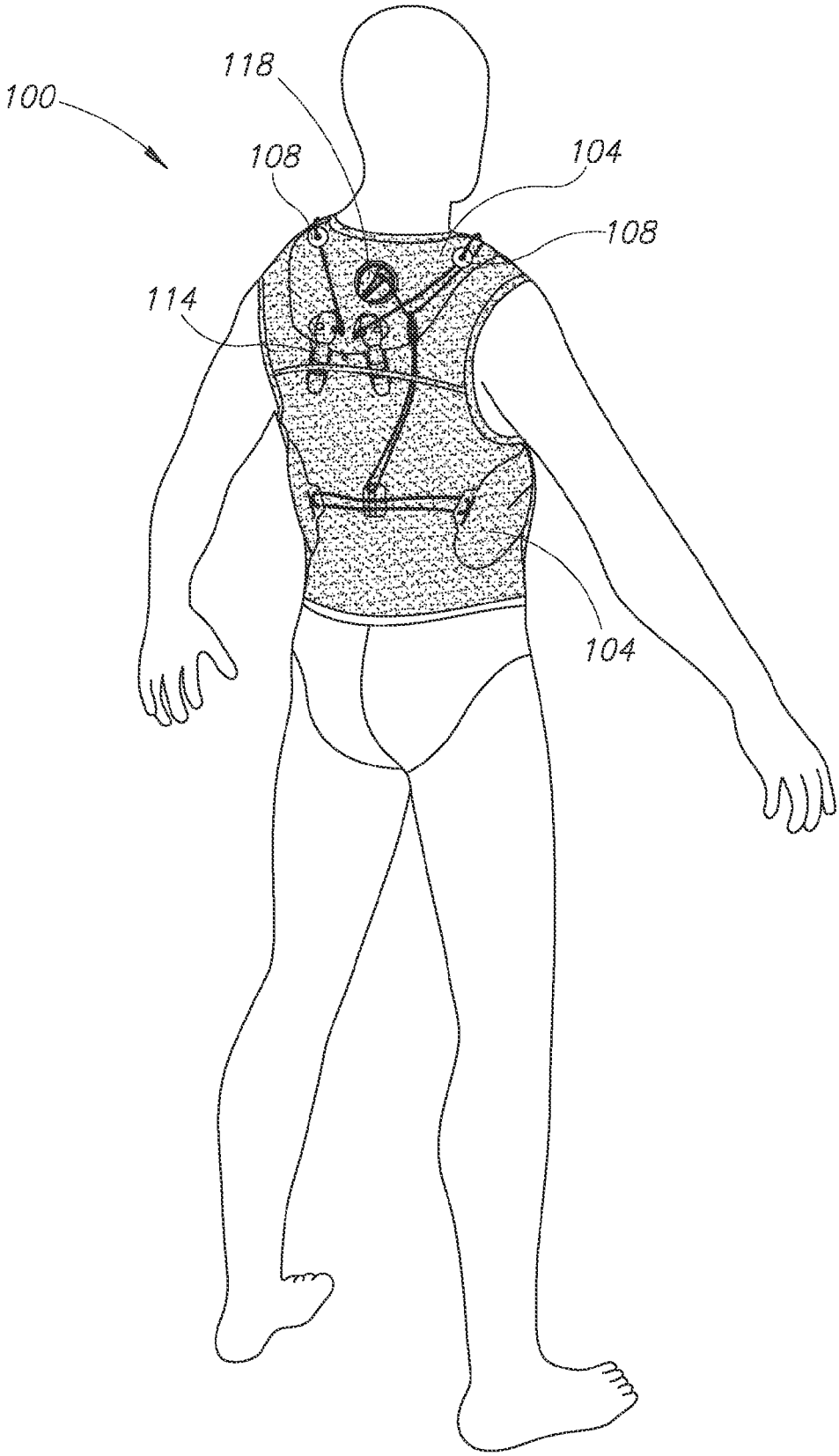
Figure 2A:
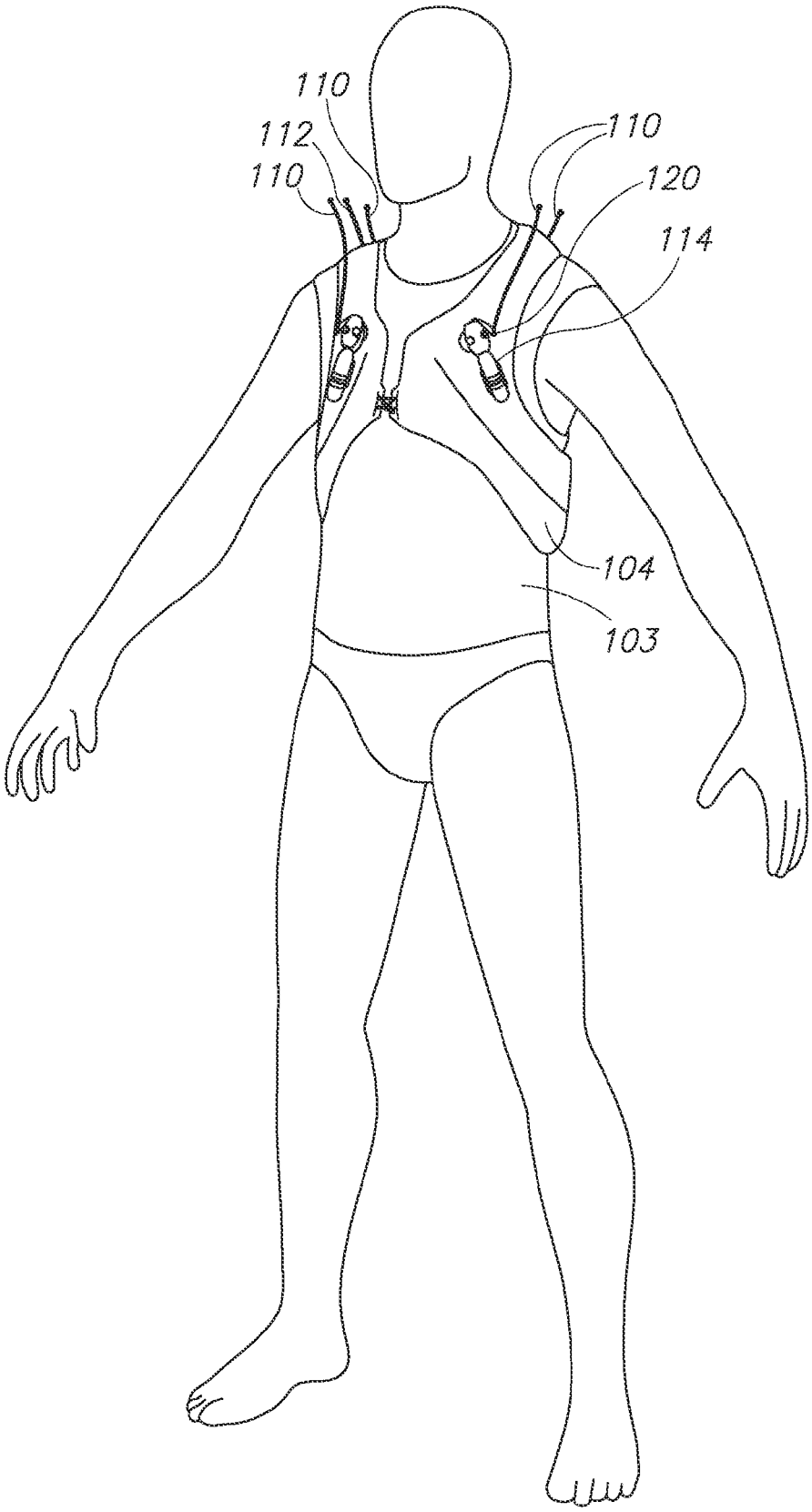
FIGS. 2A and 2B are front and rear views, respectively, of the device according to embodiments of the present disclosure.
Figure 2B:
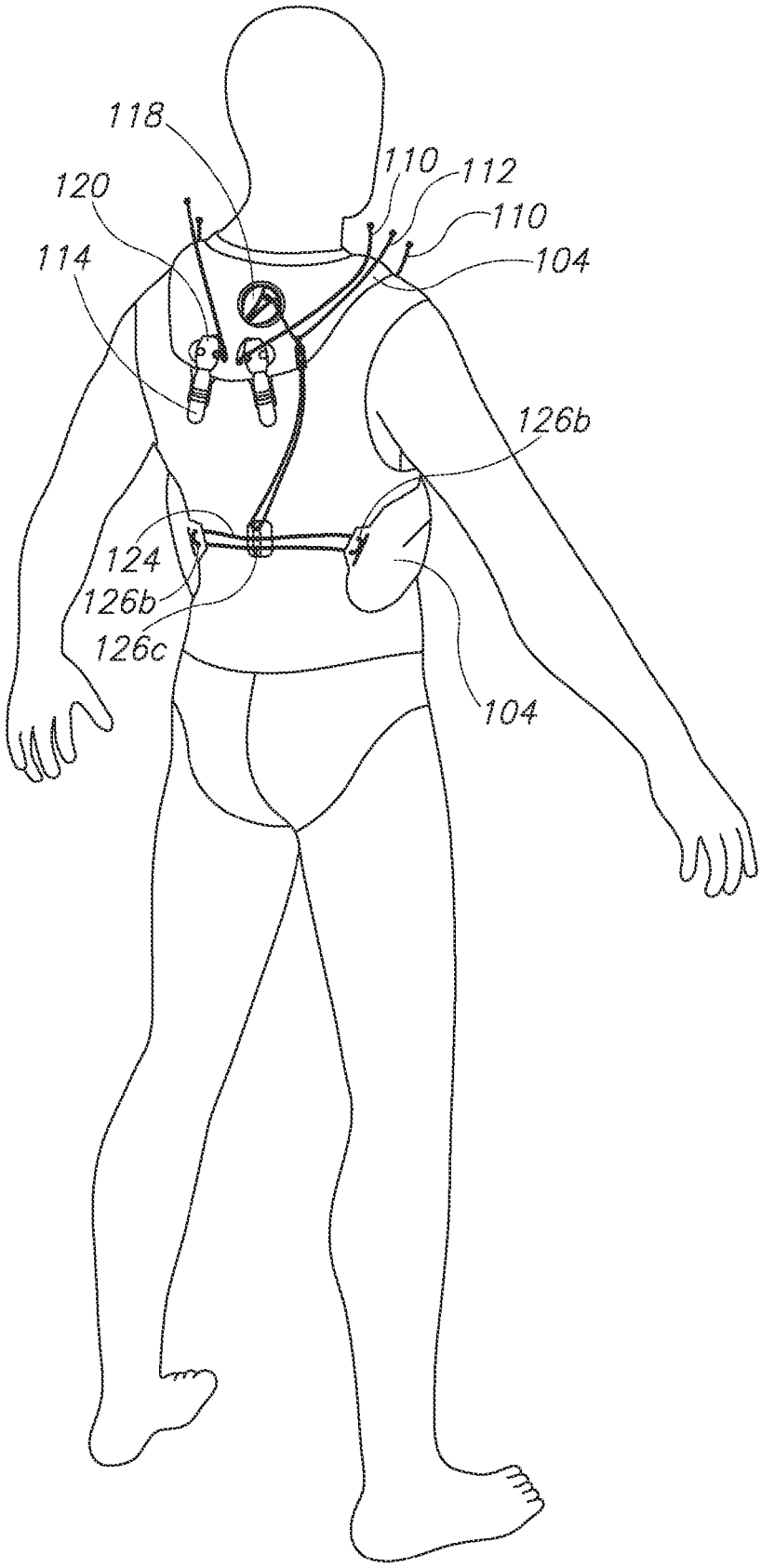

FIGS. 1A and 1B are front and rear views, respectively, of an inflatable, wearable device 100 according to embodiments of the present disclosure. The device 100 includes an outer layer 102 and a bladder 104 held within the outer layer 102 and secured relative to the wearer's body. FIGS. 2A and 2B are front and rear views, respectively, of the device 100 with the outer layer 102 removed for visibility. The device 100 also includes drawstrings 124 passing through eyelets 126*a*, 126*b*, and 126*c* to secure the bladder 104 to the wearer. The drawstring can be made of flexible material, such as shock cord or another suitable material. In some embodiments the outer layer 102 can be omitted and the bladder 104 and other components can be attached to the inner layer 103. The device 100 also includes an inner layer 103 (shown to greater advantage in FIGS. 2A and 2B) underneath the bladder 104. The eyelets 126*c* can be formed in a tab connected to the outer layer 102 or inner layer 103, or the eyelets 126*c* can be formed directly into the outer layer 102 or the inner layer 103. The eyelets 126*c* route the drawstrings of the device 100 to enable the wearer to adjust the size of the device 100 and to find a comfortable fit.

The device 100 also includes a source of pressurized gas, such as a canister 114, coupled to the bladder 104 ready to deliver pressurized gas into the bladder on command by the wearer or another person, such as a lifeguard or rescue professional. The device 100 also includes a trigger mechanism 120 coupling the canisters 114 to the bladder 104. The trigger mechanism 120 has a ripcord 110 that, when pulled, releases pressure from one or more of the canisters 114 into the bladder 104 to make the device 100 float in water. Thus, the canister pressure may substantially equalize with the pressure in the bladder or just a portion of the pressure in the canister may be released such that the pressure in the canister remains higher than that in the bladder. If the pressure is completely equalized, the canister is essentially emptied. In some embodiments, the device 100 provides face-up flotation, and will turn an unconscious person face-up in the water. The device 100 also includes a release valve 118 coupled to a release cable 112 that can be actuated to release pressure from the bladder 104 to allow the wearer to resume activities and maintain the capability to inflate the bladder 104 a second or third time, or as many times as the pressure source permits. The release valve 118 can also include a self-regulating pressure release valve to prevent overfilling of the bladder 104. With this valve, the canister can hold more than one bladder charge as well—the valve allowing only a certain amount of gas from the canister into the bladder and retaining enough to later refill (or at least partially refill) the bladder.

The device 100 can be used in water sports such as surfing or river rafting or another suitable sport in which the user may have need to float to the surface of the water. When in the uninflated state, the device 100 is relatively thin and therefore does not inhibit movement the way a conventional life preserver would. A surfer, for example, may fall from his surfboard in high surf and may be unable to reach the surface without assistance. He can pull the ripcord 110 to actuate the trigger mechanism 120 to inflate the bladder 104. As discussed in greater detail below, the device 100 can include multiple canisters 114 and multiple actuation triggers and/or actuation modes by which the wearer can achieve different levels of pressure in the bladder or to actuate the device 100 multiple times without having to recharge or replace the canisters 114. The wearer may also wish to inflate the bladders preemptively which he can do easily by pulling the ripcord 110 at any time.

In some embodiments, the outer layer 102 includes eyelets, such as front eyelets 106 and rear eyelets 108, through which the ripcord 110 passes. The eyelets direct the ripcord 110 in certain directions relative to the triggers 120 to which they are connected to facilitate multi-mode operation. For example, the ripcord 110 can include multiple cables of different lengths such that when the ripcord 110 is pulled in different directions, different cables are tensioned and therefore different canisters 114 are triggered. The eyelets 106, 108 facilitate this operation. The device 100 can also include a right ripcord and a left ripcord, each coupled to canisters or other pressure sources as described herein.

Figure 3A:
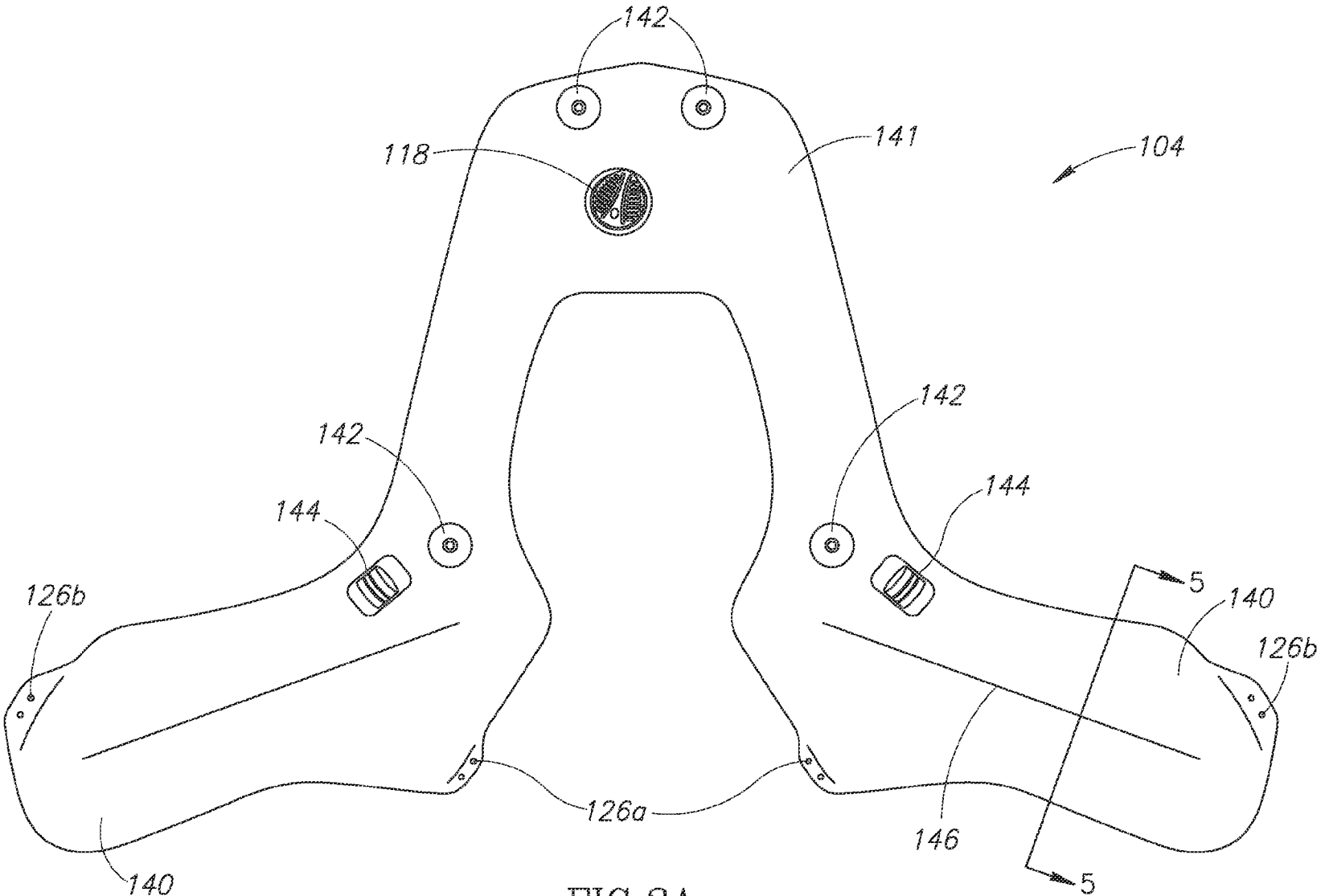
FIG. 3A illustrates the bladder of the inflatable device of FIGS. 1A-2B according to the present disclosure.
Figure 3B:
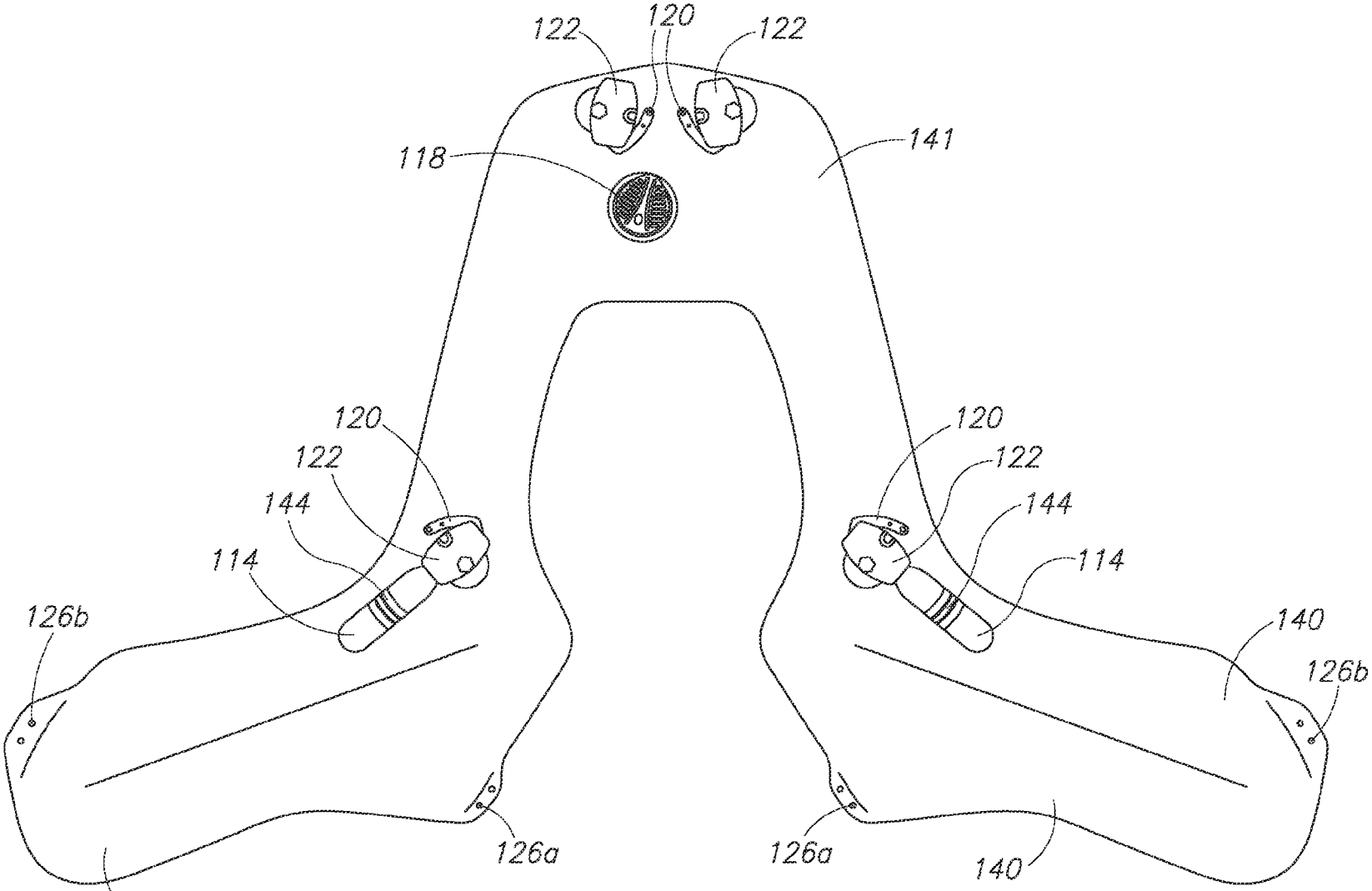
FIG. 3B shows the bladder with canisters attached to the input valves and to the bladder via the canister straps according to the present disclosure.

FIG. 3A illustrates the bladder 104 of the inflatable device 100 of FIGS. 1A-2B according to the present disclosure. The bladder 104 includes front portions 140 and a U-shaped rear portion 141 that encircles the wearer's neck. The front portions 140 can include front drawstring eyelets 126*a* that draw the front portions 140 together to fit to the wearer's chest. The bladder 104 also includes rear drawstring eyelets 126*b* that can further tighten and adjust to fit the wearer. The bladder 104 includes input valves 142 and canister straps 144 near the input valves 142. FIG. 3B shows the bladder 104 with canisters 114 attached to the input valves 142 and to the bladder 104 via the canister straps 144 (rear canisters not pictured). The canisters 114 are coupled to the input valves 142 with couplers 122 having levers or latches 120 to which the ripcord is attached. In some embodiments, the canisters 114 can be off-the-shelf bicycle tire inflation canisters of $CO_2$ or other readily available pressure sources. The latches 120 can have internal cams and needles pressed into the canister by the cam to puncture the canisters 114 to release the pressurized gas into the bladder 104. The canisters 114 can be screwed into the couplers 122 and held in a ready position until deployment. One advantage of this configuration is that the canisters 114 are, at the time of this writing, permitted to be brought aboard commercial airplanes provided they are coupled to a device such as the inflatable device 100 of the present disclosure whereas loose canisters are generally not permitted. The canisters 114 can be easily swapped out for new canisters quickly—even while the wearer stays in the water.

Figure 4:
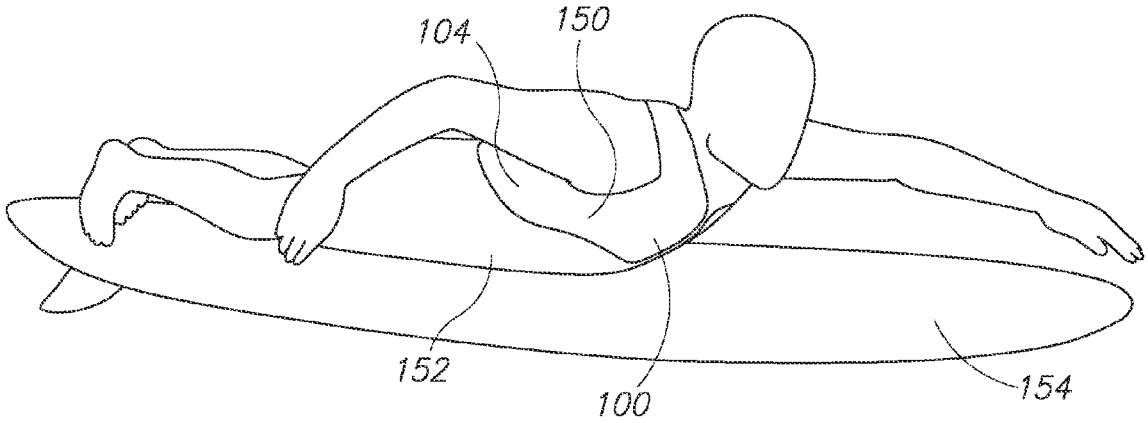
FIG. 4 shows a wearer using the device while paddling a surfboard according to embodiments of the present disclosure.

FIG. 4 shows a wearer using the device 100 while paddling a surfboard 154 according to embodiments of the present disclosure. The outline of the bladder 104 is shown, and portions of the outer layer 102 and inner layer 103 are omitted in this Figure for ease of explanation. As also shown to advantage in FIGS. 2A and 4, the bladder 104 is shaped to cover the wearer's ribcage 150 leaving the wearer's stomach 152 uncovered permitting the wearer to lay flat on a surface such as a surfboard for paddling. Also, as circumstances may require, when the wearer is pulled from the water during turbulent conditions by a rescue team using, for example, a personal watercraft (e.g., a JET SKI®) or similar vehicle, the shape of the bladder 104 helps the wearer stay flat and stable on the surface without excessive pressure on the soft tissues of the stomach. In some embodiments, the bladder 104 has an inverted V-shape, having an apex and arms extending downwardly and outwardly along the wearer's ribcage. The lowest point of the center of the bladder 104 can be approximately at the base of the wearer's sternum, and the upper middle portion can be at any suitable intermediate point along the sternum up to and including the interior ends of the clavicle and the manubrium of sternum. The bladder 104 can contour comfortably under the wearer's arms and over a portion of the wearer's back.

Figure 5:
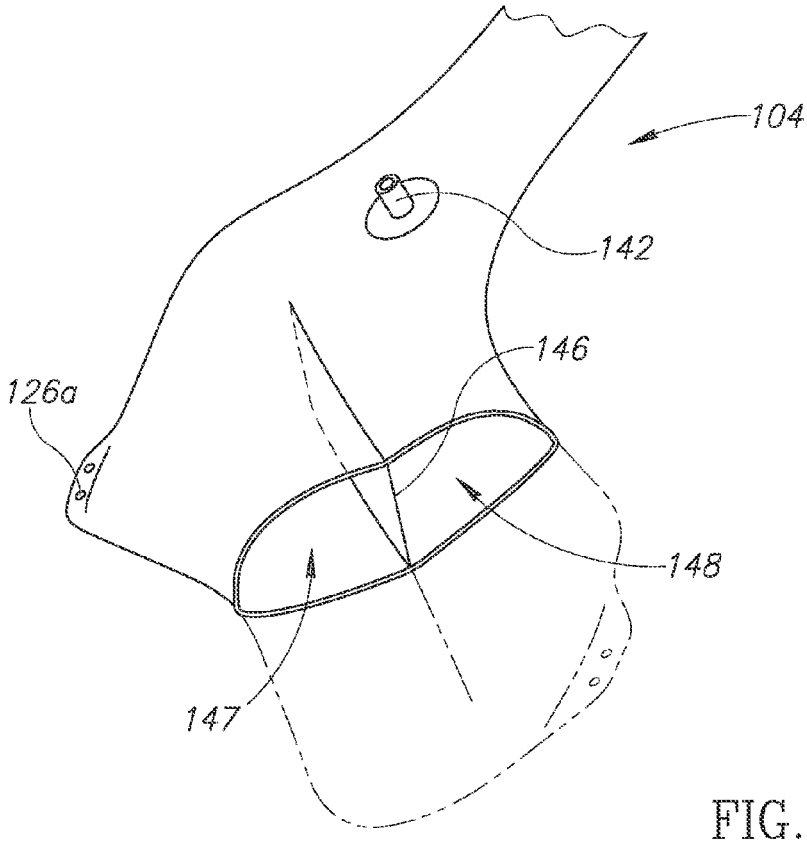
FIG. 5 shows a cut-away view of the bladder and baffle according to embodiments of the present disclosure.

Referring briefly back to FIG. 3A, the bladder 104 also includes a baffle 146 that can be attached to a portion of the inner and outer walls of the bladder 104. FIG. 5 shows a cut-away view of the bladder 104 and baffle 146 according to embodiments of the present disclosure. The baffle 146 constrains the shape of the bladder 104 to be more flat and spread evenly along the user's chest instead of tending to a single, round volume. The baffle 146 separates the bladder 104 into a lower chamber 147 and an upper chamber 148. These chambers are not necessarily separate and the air in the bladder 104 is free to travel around the ends of the baffle 146, but by virtue of the attachment to the inner and outer walls of the bladder 104 the baffle 146 achieves the desired shape constraint. In other embodiments, the bladder 104 can have more than one baffle and therefore more than two chambers. For example, a bladder 104 suited for a larger person may desirably have more than one baffle to achieve the shape constraint. In some embodiments, the baffle 146 is itself solid; in other embodiments the baffle 146 permits air to pass through, such as a webbing or a series of pillars. Virtually any baffle configuration is possible.

Figure 6:
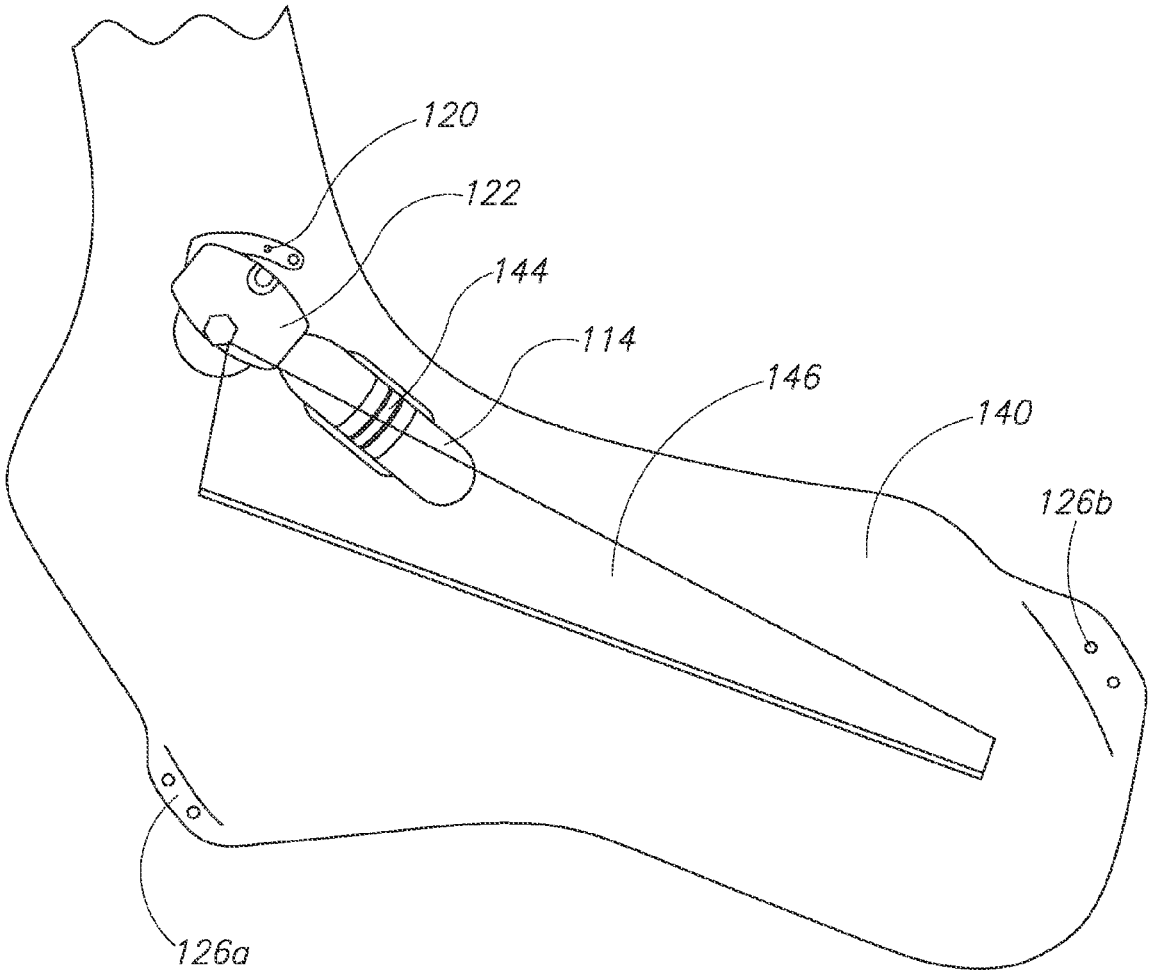
FIG. 6 illustrates another baffle configuration for an inflatable device according to embodiments of the present disclosure.

FIG. 6 illustrates another baffle configuration for an inflatable device according to embodiments of the present disclosure. The baffle 146 in this embodiment has a wedge-shape that is wider at an upper portion near the canister 114 and narrower at the lower end. This permits the baffle 146 to be thicker at the upper portion and constrains the lower end to a thinner shape, which can allow greater freedom of movement of the wearer's arms.

Figure 7:
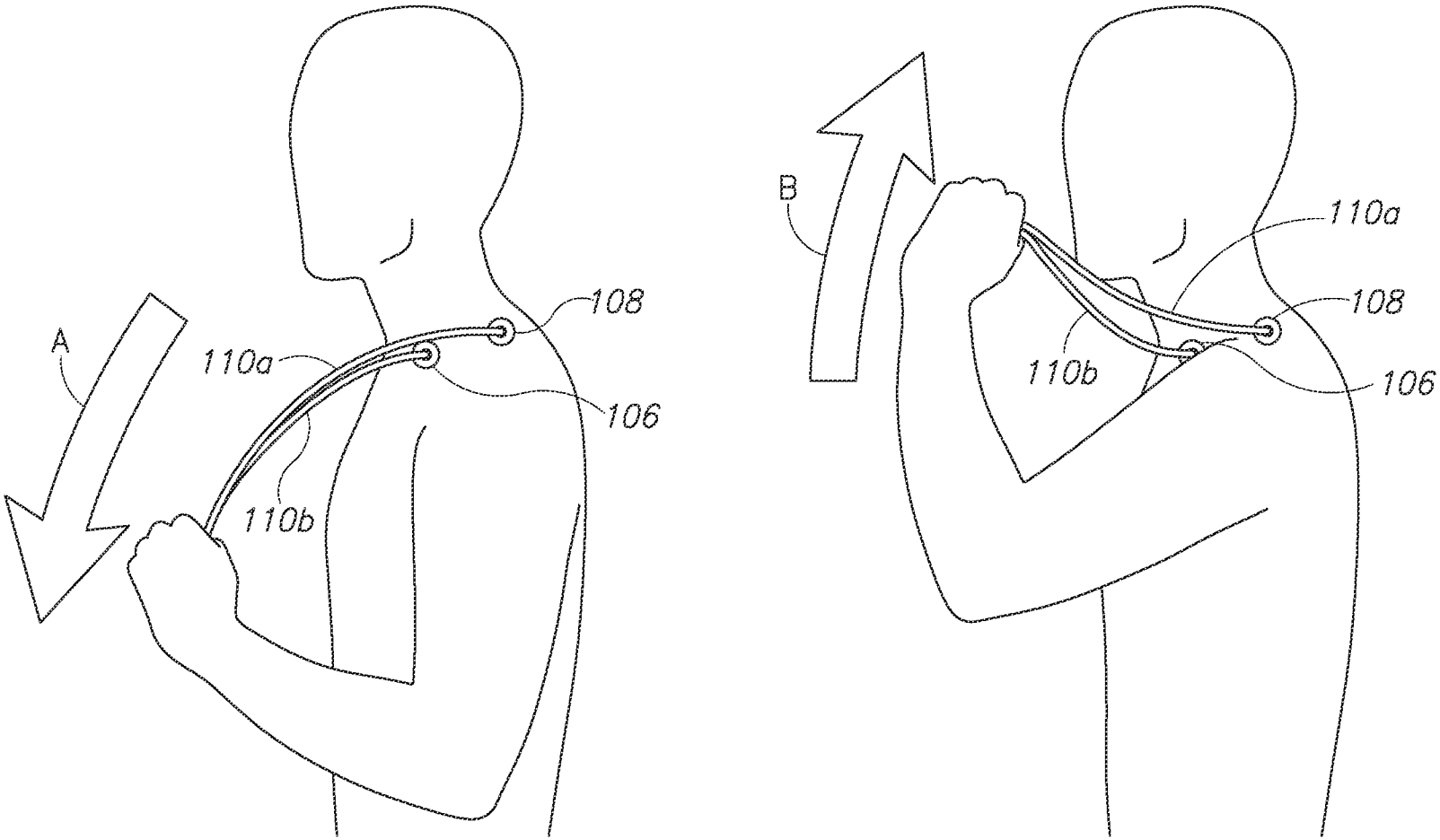
FIG. 7 illustrates a schematic deployment configuration for the device of the present disclosure.

FIG. 7 illustrates a schematic deployment configuration for the device of the present disclosure. As stated above, the device according to embodiments of the present disclosure can be deployed any number of times to deliver discrete or continuous amounts of air to the bladder for inflation. In one embodiment, the deployment mechanism is a ripcord having a first cable 110*a* and a second cable 110*b*. The first cable 110*a* passes through a first eyelet 108, and the second cable 110*b* passes through a second eyelet 108 spaced apart from the first eyelet 108. The cables 110*a*, 110*b* can have different lengths. The first and second cables 110*a*, 110*b* can be connected at a distal end in a single handle. Pulling the ripcord forward as shown by arrow A tensions the first cable 110*a* while the second cable 110*b* remains slack. This causes the canister attached to the first cable 110*a* to deploy and the other canisters to remain undeployed. Pulling the ripcord upward, such as shown by arrow B, causes the second cable 110*b* to tension and deploy the associated canister. In this way, the wearer can selectively deploy different, discrete gas canisters into the bladder to achieve a desired level of flotation, or to achieve flotation at multiple different times. For example, if a surfer takes a fall in high surf and deploys one of the gas canisters for flotation, after reaching the surface the surfer can release the air from the bladder and continue to surf knowing that if he takes another fall he can deploy the second canister by pulling on the ripcord in a different direction to deploy the second canister.

The deployment mechanism for the device can alternatively be a switch, knob, button, or any other actuation device having multiple deployment modes, such as rotation (left/right), pushing/pulling, twisting, or any other suitable mechanical or electromechanical deployment mode having multiple modes of deployment. The modes can be distinguished by degree. For example, a first mode can be deployed by pressing a button or turning a knob a certain distance, and a second mode can be deployed by pressing the button or knob the same direction but a greater distance.

Figure 8:
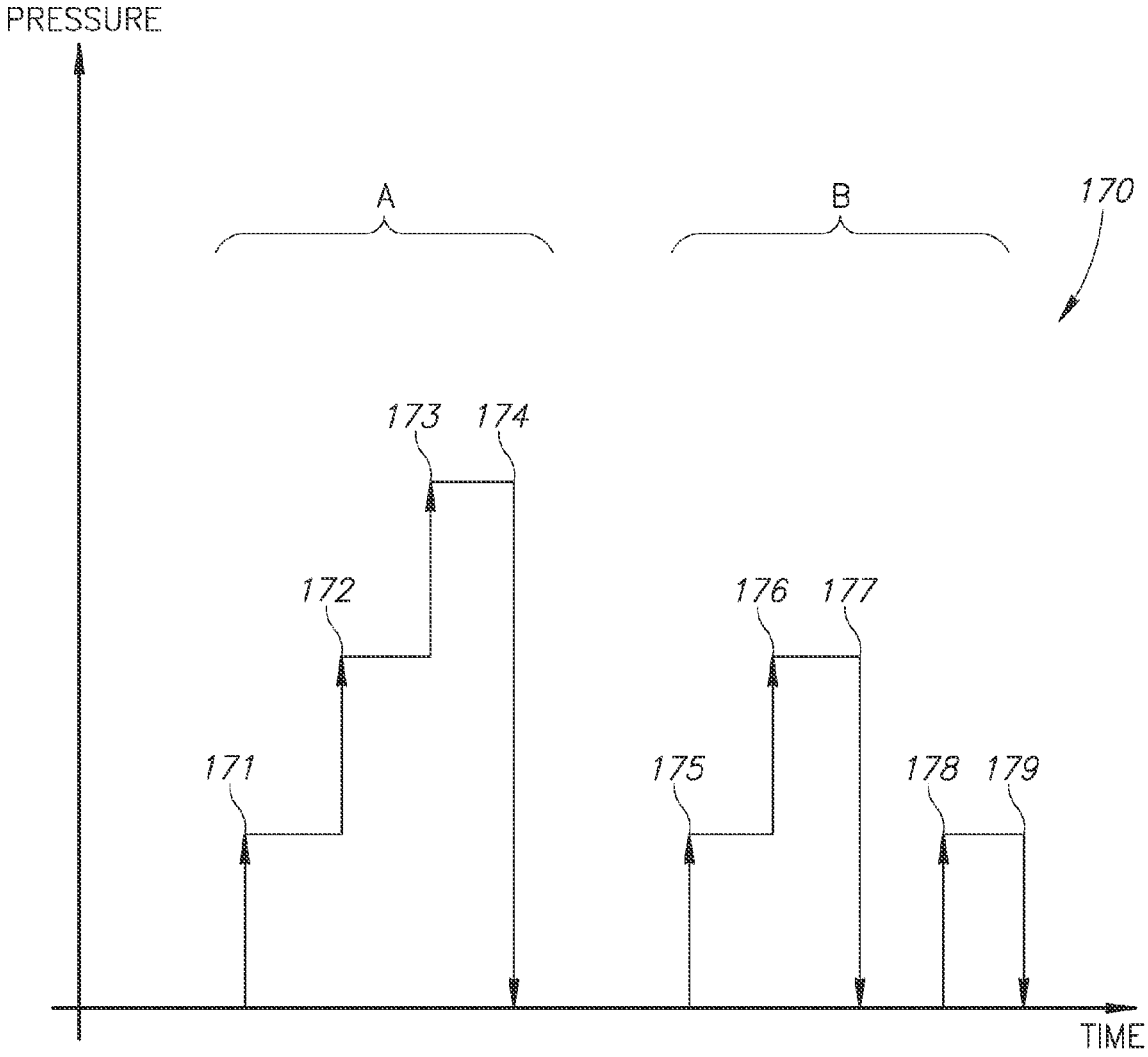
FIG. 8 is a graph of pressure against time showing two possible deployment scenarios for the device of the present disclosure.

The inflation and release switches are independently operated allowing the pressure to be increased or decreased in virtually any order. FIG. 8 is a graph of pressure against time showing two possible deployment scenarios for the device of the present disclosure. Before deployment, the pressure in the bladder is effectively zero. In a first deployment scenario A, when the wearer deploys one of the canisters at 171, the pressure increases by a certain discrete amount. While the bladder is pressurized, the wearer can deploy a second canister at 172 to increase the pressure. The wearer can deploy a third canister at 173 to still further increase the pressure in the bladder. (Any suitable number of canisters can be deployed. For purposes of illustration, this graph shows an embodiment with three canisters.) At 174 the wearer can release all the pressure from the bladder. This scenario can be useful in situations where the wearer finds himself in deep water where the pressure from one or two canisters provides insufficient flotation.

In scenario B, the wearer first deploys the first and second canisters at 175 and 176 before releasing the pressure at 177. Later, still having a third canister ready for deployment, the wearer can deploy the third canister at 178 and release it at 179. Conventional inflation devices would require that the wearer in scenario B leave the water and recharge the pressure source, or even acquire a new device, before continuing his activities. The independent and multiple deployment mechanism of the present disclosure enables the wearer to stay on the water for as many canister deployments as his device carries. These two scenarios are not limiting; rather, they are illustrative of the independency between canister discharges and releases. In other scenarios, the wearer may release part, but not all of the air in the bladder. In other scenarios, different canisters have different volumes of gas enabling the wearer to deploy a large, medium, or small canister as occasion requires. The number of possible deployment scenarios is limited only by the number of canisters and the permutations of deploying the canisters.

In other embodiments, the pressure sources are not discrete, but rather can be opened to a desired volume by pulling a ripcord a certain distance or for a certain duration. In still further embodiments, the device can include a sensor, such as a pressure sensor or displacement sensor that detects when the bladder achieves a certain volume of inflation and therefore flotation. For example, if the device is under sufficient pressure, the bladder—even after deploying a canister of gas—will not inflate appreciably and therefore will not provide flotation. Increasing the pressure within the bladder will eventually expand the volume of the bladder sufficiently to provide enough flotation for the wearer. The sensor can detect when the volume of the bladder reaches the desired volume and cease delivery when the desired volume is reached and maintain the remaining pressure for a subsequent discharge event. In this embodiment, the deployment mechanism can be singular because the device automatically fills until a predetermined flotation threshold and not further. The device can include a gauge to inform the wearer how much pressure remains after discharge.

Figure 9:
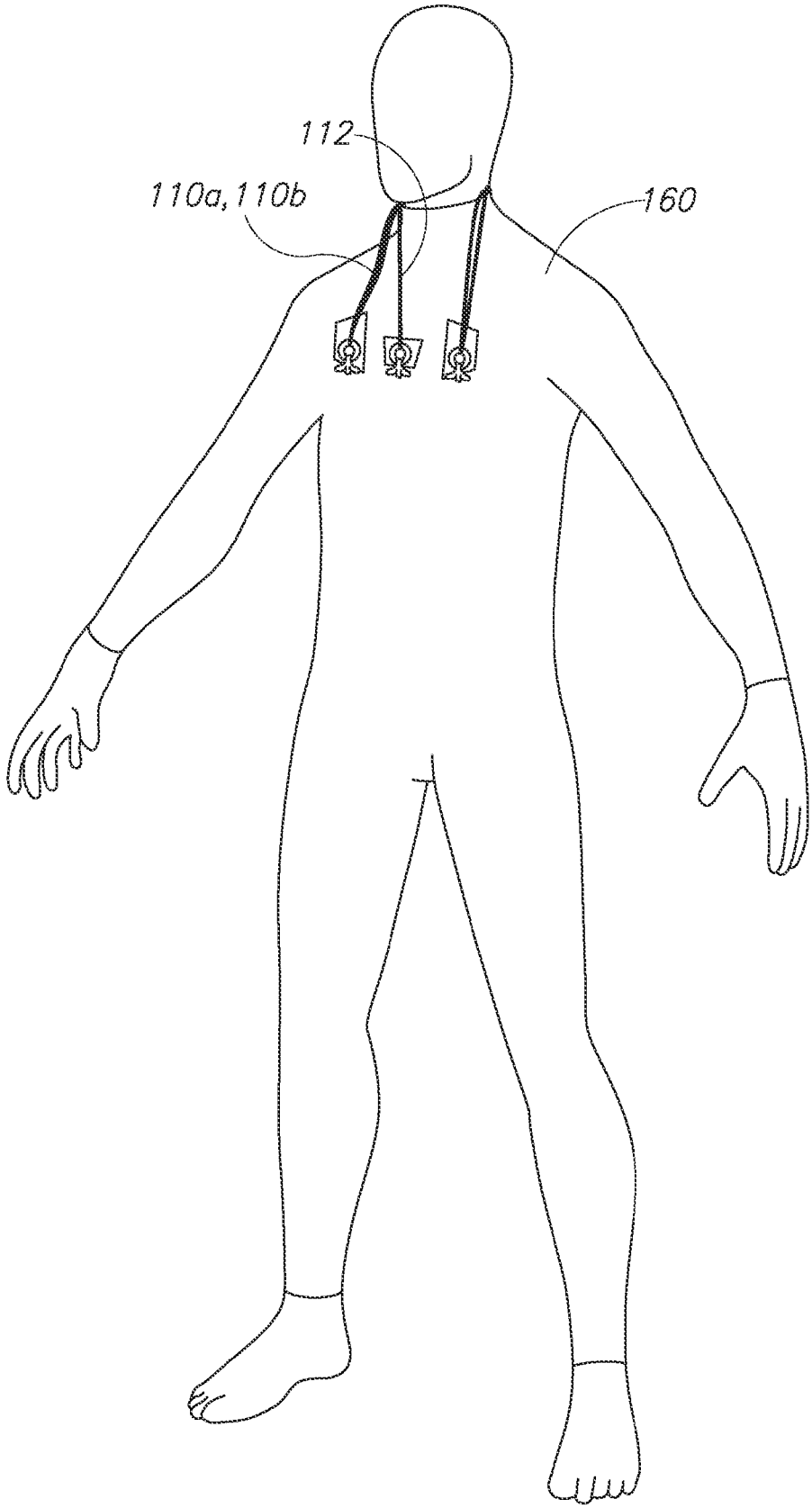
FIG. 9 illustrates a wearer using the device of the present disclosure with a conventional wetsuit over top.

FIG. 9 illustrates a wearer using the device of the present disclosure with a conventional wetsuit over top. The ripcords 110*a*, 110*b* and release cable 112 can be fed through the neck of the wetsuit and the device 100 can be operated as described herein. The flexible nature of the wetsuit will generally accommodate the expansion of the bladder to achieve the desired flotation.

Figure 10:
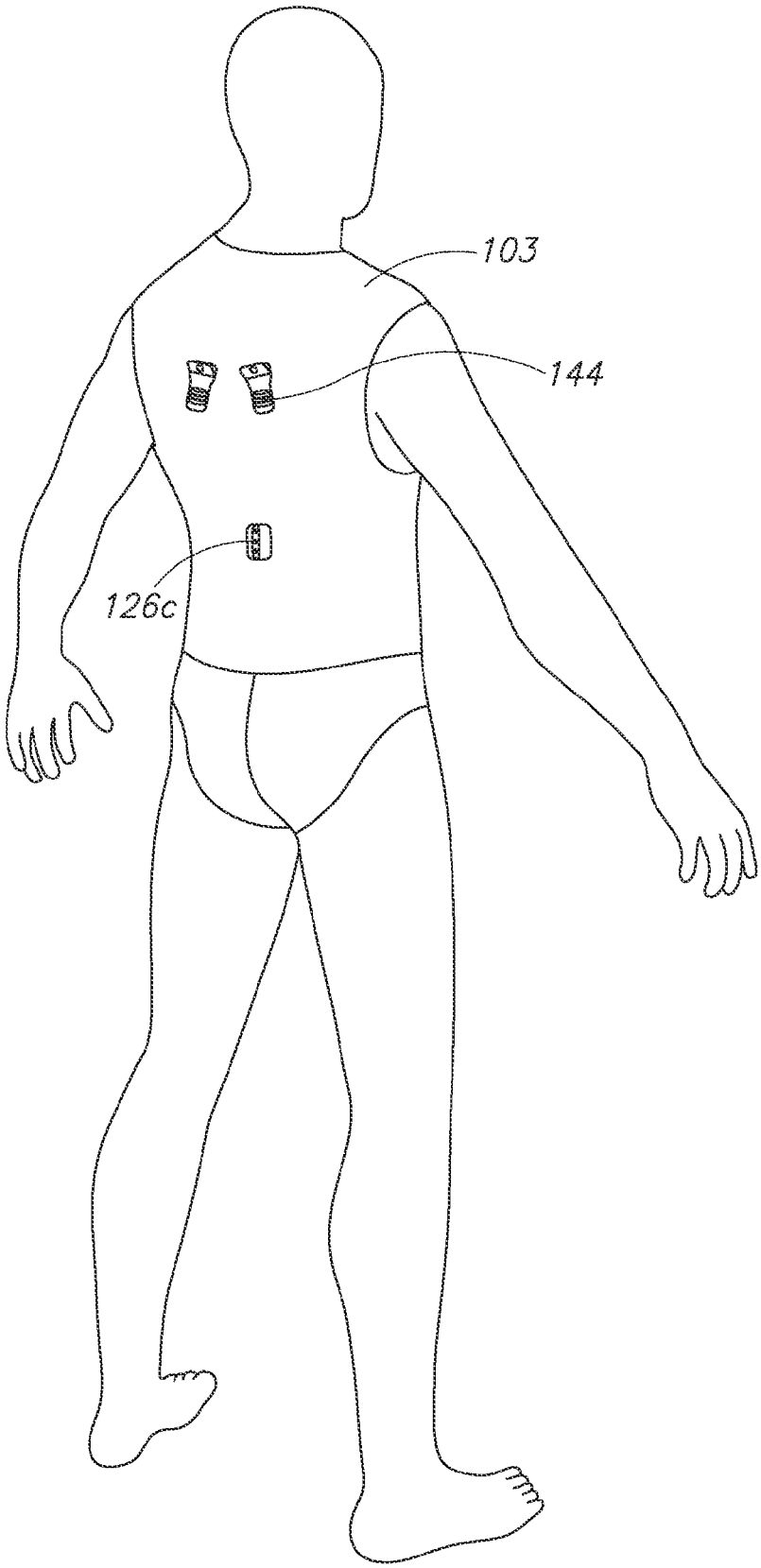
FIG. 10 is a back view of a device according to embodiments of the present disclosure.

FIG. 10 is a back view of a device 100 according to embodiments of the present disclosure. The device 100 includes an inner layer 103, canister straps 144 at the back of the device 100, and drawstring eyelets 126 on the inner layer 103. The drawstring eyelets can be on a tab that protrudes from the inner layer 103 to permit the drawstring to be pulled through the eyelets 126 to cinch the device 100 tight against the wearer's body. In some embodiments, the canisters can be attached to the inner layer 103 as shown in FIG. 10. In other embodiments the canister straps 144 are attached to the bladder 104 (FIGS. 1A-2B), and in still other embodiments the canisters straps 144 are attached to an inner surface of the outer layer 102 (FIGS. 1A and 1B).

Figure 11A:
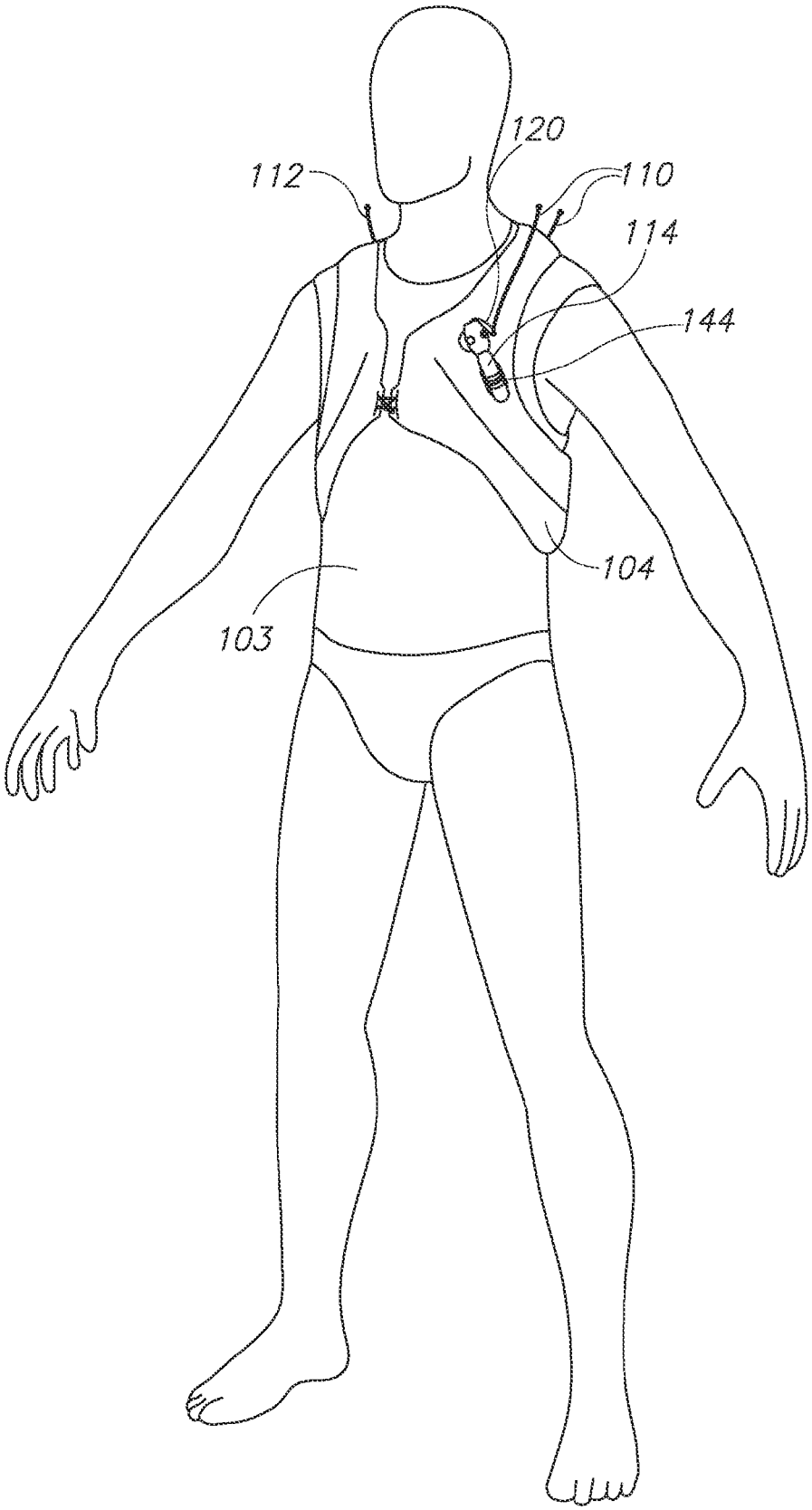
FIGS. 11A and 11B are front and back views, respectively, of a device 100 according to still further embodiments of the present disclosure.
Figure 11B:
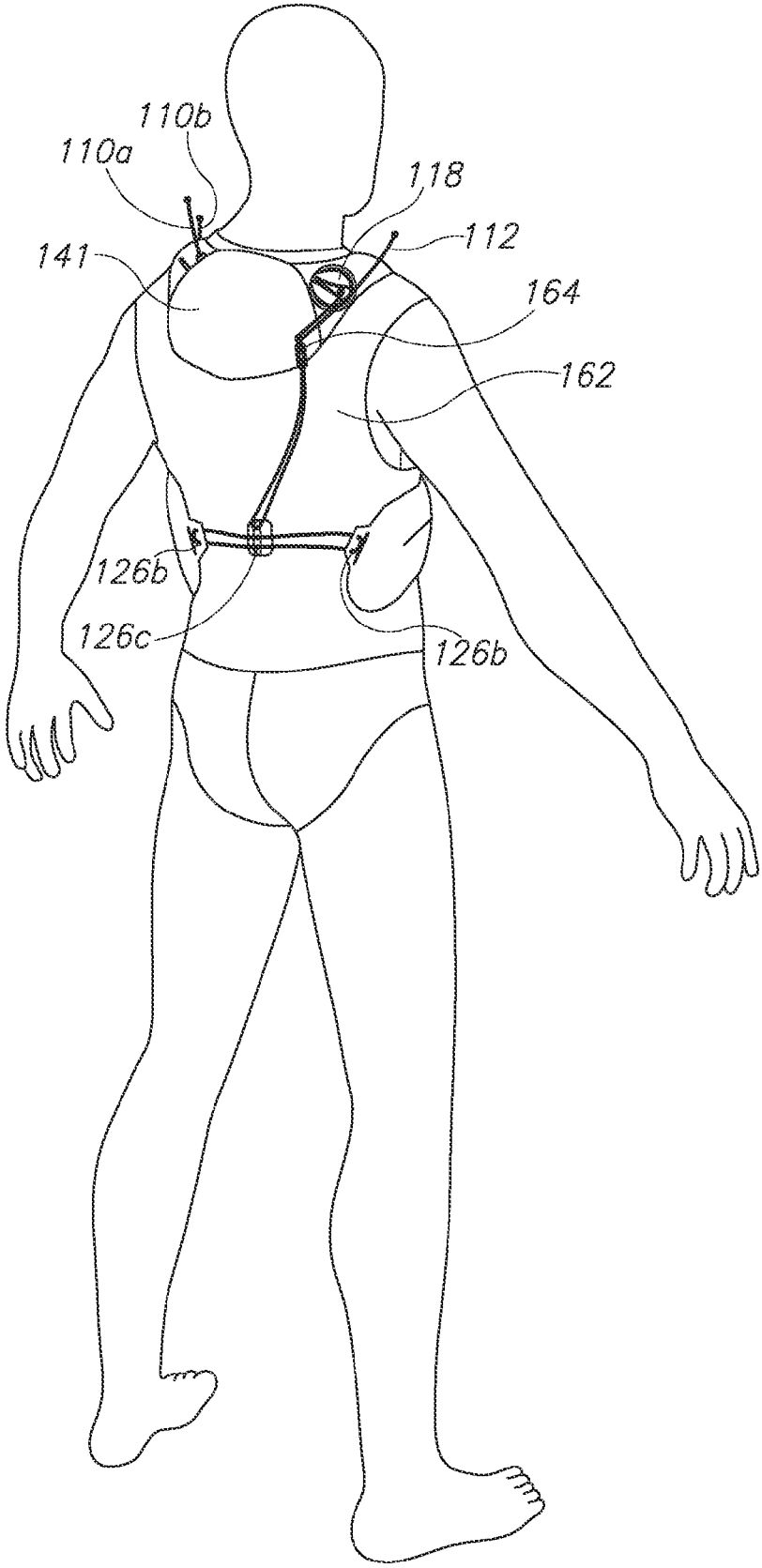

FIGS. 11A and 11B are front and back views, respectively, of a device 100 according to still further embodiments of the present disclosure in which the bladder 104 has a different configuration. The device 100 includes a bladder 104, an inner layer 103, a canister strap 144, canisters 114, couplers 122 between the canisters 114 and the bladder 104, and a ripcord 110 attached to the coupler 122 ready to actuate the coupler 122 via a latch mechanism 120. The bladder 104 includes a rear portion 141 having a large chamber at the base of the wearer's neck. The device 100 also includes a release valve 118 positioned above the wearer's shoulder and off to one side of the bladder 104. There are no canisters on the back side of the device 100 in this embodiment. This may be desirable if the wearer plans to spend time lying on his back because there are no canisters to make doing so uncomfortable. In other embodiments, the canisters 114 can be positioned differently, including adding them to the back of the vest. In general, the canisters 114 can be positioned to maximize comfort depending on the wearer's intended activities.

All of the embodiments and methods disclosed and claimed herein can be made and executed without undue experimentation in light of the present disclosure. For example, the wearable device can be shaped to be worn on any part of the body, such as the torso, legs, waist, arms, legs, hands, feet, neck, or head etc. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. An inflatable, wearable device, comprising:

an inflatable bladder, wherein the inflatable bladder has a wishbone shape substantially matching a wearer's ribcage;

a pressurized gas chamber coupled to the inflatable bladder;

an inflate trigger operably coupled to the pressurized gas chamber, wherein operating the inflate trigger causes the pressurized gas chamber to deliver at least a portion of the gas within the pressurized gas chamber into the inflatable bladder;

a deflate trigger operably coupled to the inflatable bladder, wherein operating the deflate trigger permits at least a portion of the gas to escape the inflatable bladder; and a body engaging portion coupled to the inflatable bladder and configured to secure the inflatable device to the wearer's body.

2. The inflatable, wearable device of claim 1, further comprising a compensating valve on the inflatable bladder that will release air from the inflatable bladder if pressure within the bladder reaches a predetermined threshold.

3. The inflatable, wearable device of claim 1 wherein the body engaging portion comprises a vest.

4. The inflatable, wearable device of claim 1 wherein the pressurized gas chamber comprises one or more gas cartridges.

5. The inflatable, wearable device of claim 1, further comprising a rip cord that, when pulled, actuates the inflate trigger.

6. The inflatable, wearable device of claim 1 wherein the trigger comprises a ripcord, and wherein pulling the rip cord in a first direction causes the pressurized gas chamber to deliver a first quantity of gas into the inflatable bladder and wherein pulling the rip cord in a second direction causes the pressurized gas chamber to deliver a second quantity of gas into the inflatable bladder.

7. The inflatable, wearable device of claim 1 wherein the trigger comprises a ripcord comprising a first cable and a second cable joined at a handle at a distal end of the ripcord, wherein the first cable and the second cable extend from a first and second aperture in the inflatable device, respectively, and wherein the first and second aperture in the inflatable device are spaced apart from one another.

8. The inflatable, wearable device of claim 1 wherein the trigger comprises a ripcord having a first cable having a first length and a second cable having a second length different than the first length, and wherein pulling the ripcord in a first direction causes the pressurized gas chamber to deliver a first quantity of gas into the inflatable bladder and wherein pulling the ripcord in a second direction causes the pressurized gas chamber to deliver a second quantity of gas into the inflatable bladder.

9. The inflatable, wearable device of claim 1 wherein the inflate trigger is configured to be operated in at least a first and a second way, and wherein operating the inflate trigger in the first way causes some, but not all, of the pressure from the pressurized gas chamber to pass into the inflatable bladder, and wherein operating the inflate trigger in the second way causes some, but not all, of the pressure from the pressurized gas chamber to pass into the inflatable bladder, and further wherein operating the inflate trigger in the first way and then in the second way causes the pressure in the pressurized gas chamber and in the inflatable bladder to substantially equalize.

10. The inflatable, wearable device of claim 1, further comprising attachment means for securing the inflatable device to another article of clothing.

11. The inflatable, wearable device of claim 1 wherein the pressurized gas chamber is configured to be pressurized using a manual pump.

12. An inflatable device, comprising:

a vest;

a gas pressure source; and a bladder, wherein the gas pressure source is coupled to the bladder to selectively deliver gas to the bladder to pressurize the bladder;

the vest is coupled to the bladder to hold the bladder in place relative to a wearer's chest;

the bladder has an inverted V shape having an apex and arms extending from the apex, with the apex of the inverted V being positioned at an intermediate point on the wearer's sternum and extending to the lower portion of the wearer's sternum, the arms of the inverted V shape extending downwardly and outwardly from the apex of the inverted V shape to substantially follow the contour of the wearer's ribcage, and wherein the user's stomach area below the sternum is not substantially covered by an inflatable portion.

13. The inflatable device of claim 12, further comprising baffles in the bladder to limit the extent to which the bladder protrudes from the user's chest when inflated.

14. The inflatable device of claim 12, further comprising a ripcord that, when actuated, enables the gas pressure source to deliver the gas into the bladder.

15. The inflatable device of claim 14 wherein the ripcord has a first cable and a second cable, wherein the first cable has a first length and the second cable has a second length different than the first length, and wherein pulling the ripcord in a first direction causes the first cable to tension and actuate the gas pressure source to release a first quantity of gas into the bladder, and wherein pulling the ripcord in a second direction causes the second cable to tension and actuate the gas pressure source to release a second quantity of gas into the bladder.

16. The inflatable device of claim 12 wherein the trigger has two or more modes of actuation, each of which releases a discrete quantity of gas into the bladder.

17. The inflatable device of claim 12, further comprising a release valve configured to release all or part of the gas from the bladder in response to actuation by the wearer.

18. A method of inflating and deflating an inflatable device in a wearable garment, the method comprising:

in response to actuating a first inflate trigger, delivering a discrete amount of pressurized gas into a bladder secured to the wearable garment, wherein the garment holds the bladder in position relative to a wearer's body and the bladder has a wishbone shape substantially matching the wearer's ribcage;

in response to actuating a second inflate trigger, delivering a discrete amount of pressurized gas into the bladder; and in response to actuating a release trigger, releasing a discrete amount of the pressurized gas from the bladder, wherein the first inflate trigger can be actuated before or after the second inflate trigger is actuated, and wherein the release valve can be actuated after the first inflate trigger is actuated, after the second actuation trigger is actuated, or after both the first and second inflate triggers are actuated.

19. The method of claim 18, further comprising releasing a portion of the pressurized gas if the pressure in the bladder exceeds a predetermined threshold.

20. The method of claim 18 wherein the amount of pressurized gas delivered by actuating the first inflate trigger is substantially the same as the amount of pressurized gas delivered by actuating the second inflate trigger.

21. The method of claim 18 wherein the amount of pressurized air released by actuating the release trigger is substantially the same as the amount of pressurized gas delivered into the bladder by actuating the first or second inflate triggers.

22. An inflatable, wearable device, comprising:

an inflatable bladder;

a pressurized gas chamber coupled to the inflatable bladder, wherein the gas within the pressurized gas chamber is separate from breathable air available to a wearer;

an inflate trigger operably coupled to the pressurized gas chamber, wherein operating the inflate trigger causes the pressurized gas chamber to deliver at least a portion of the gas within the pressurized gas chamber into the inflatable bladder;

a deflate trigger operably coupled to the inflatable bladder, wherein operating the deflate trigger permits at least a portion of the gas to escape the inflatable bladder; and a body engaging portion coupled to the inflatable bladder and configured to secure the inflatable device to the wearer's body, wherein a first operation of the inflate trigger causes the pressurized gas chamber to deliver at least a portion of the gas within the pressurized gas chamber into the inflatable bladder and a second operation of the inflate trigger causes the pressurized gas chamber to deliver another portion of the gas within the pressurized gas chamber into the inflatable bladder.

23. The inflatable, wearable device of claim 22, wherein the trigger comprises a cord that bifurcates to comprise a first cord portion and a second cord portion, wherein the first cord portion extends from a first aperture in the inflatable device and the second cord portion extends from a second aperture in the inflatable device.

24. The inflatable, wearable device of claim 22, wherein the trigger comprises a cord that bifurcates at a handle to comprise a first cord portion and a second cord portion, wherein the first and the second cord portions are configured and arranged such that a plurality of separate inflate events are enabled by the handle.

25. An inflatable, wearable device, comprising:

an inflatable bladder;

a pressurized gas chamber coupled to the inflatable bladder, wherein the gas within the pressurized gas chamber is separate from breathable air available to a wearer;

an inflate trigger operably coupled to the pressurized gas chamber, wherein operating the inflate trigger causes the pressurized gas chamber to deliver at least a portion of the gas within the pressurized gas chamber into the inflatable bladder;

a deflate trigger operably coupled to the inflatable bladder, wherein operating the deflate trigger permits at least a portion of the gas to escape the inflatable bladder; and a body engaging portion coupled to the inflatable bladder and configured to secure the inflatable device to the wearer's body, wherein the inflatable bladder has an asymmetric shape that includes a first surface adjacent to the wearer's chest and an opposing second surface, wherein the inflatable bladder is configured and arranged such that when inflated, the first surface remains substantially flat along the wearer's chest and the opposing second surface expands against an environmental pressure.

26. An inflatable, wearable device, comprising:

an inflatable bladder;

a first pressurized gas chamber coupled to the inflatable bladder;

an inflate trigger operably coupled to the first pressurized gas chamber, wherein a first operation of the inflate trigger causes the first pressurized gas chamber to empty at least a portion of the first gas chamber and deliver the portion of gas within the first pressurized gas chamber into the inflatable bladder;

a deflate trigger operably coupled to the inflatable bladder, wherein operating the deflate trigger permits at least a portion of the gas to escape the inflatable bladder;

a body engaging portion coupled to the inflatable bladder and configured to secure the inflatable device to a wearer's body; and a second pressurized gas chamber coupled to the inflate bladder, wherein the inflate trigger is operably coupled to the second pressurized gas chamber, and wherein subsequent to the first operation of the inflate trigger and a first operation of the deflate trigger, a second operation of the inflate trigger causes the second pressurized gas chamber to deliver at least a portion of the gas within the second pressurized gas chamber into the inflatable bladder.

27. The inflatable, wearable device of claim 26, wherein a first operation of the inflate trigger causes the pressurized gas chamber to empty the gas chamber.

* * * * *